United States Patent [19]

Vidovic

[11] Patent Number: 4,729,335

[45] Date of Patent: Mar. 8, 1988

[54] FLOTATION ASSEMBLY

[76] Inventor: Gerda Vidovic, 446-3rd St., S. Kenora, Ontario, Canada, P9N 1J1

[21] Appl. No.: 5,419

[22] Filed: Jan. 20, 1987

[51] Int. Cl.[4] ..... B63B 35/58

[52] U.S. Cl. ..... 114/266; 441/35; 441/39; 441/40

[58] Field of Search ..... 441/35, 39, 40; 114/263, 264, 266

[56] References Cited

U.S. PATENT DOCUMENTS

| | | | |
|---|---|---|---|
| 1,049,250 | 12/1912 | Matson | 441/35 |
| 1,246,129 | 11/1917 | McLaughlin | 441/35 |
| 1,496,110 | 6/1924 | Altree . | |
| 1,927,124 | 9/1933 | Jones | 441/40 |
| 2,892,433 | 6/1959 | Walker | 441/35 |
| 3,103,907 | 9/1963 | Scholley . | |
| 3,340,553 | 9/1967 | Jones . | |
| 3,446,172 | 5/1969 | Morton et al. . | |
| 3,492,825 | 2/1970 | Pearson | 114/263 |
| 3,579,680 | 5/1971 | McLean | 114/266 |
| 3,595,192 | 8/1971 | Vega . | |
| 3,605,148 | 9/1971 | Tailer . | |
| 3,844,236 | 10/1974 | Boyajian . | |

FOREIGN PATENT DOCUMENTS

| | | | |
|---|---|---|---|
| 139566 | 3/1920 | United Kingdom | 441/35 |

*Primary Examiner*—Joseph F. Peters, Jr.
*Assistant Examiner*—Stephen P. Avila
*Attorney, Agent, or Firm*—Ciotti & Murashige, Irell & Manella

[57] ABSTRACT

A floating dock, swimming platform or the like can use airbags, foam or other flotation material held within plastic frames which may be foldable for storage or transportation surfaces upon a car top or the like.

27 Claims, 24 Drawing Figures

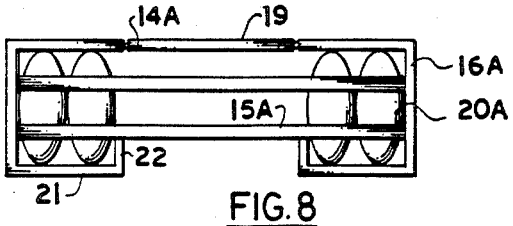
FIG. 8
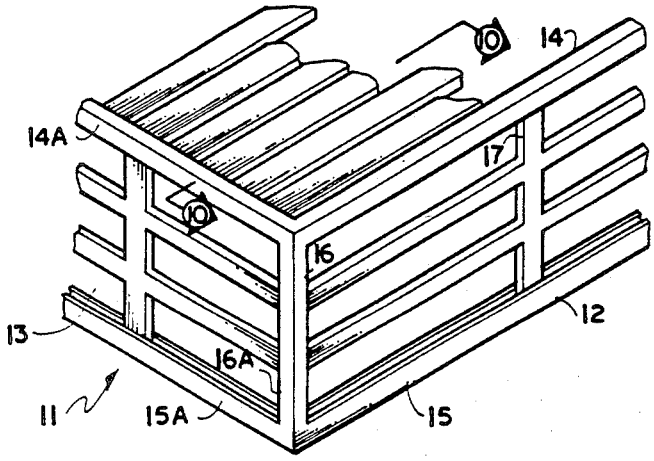
FIG. 9
FIG. 10
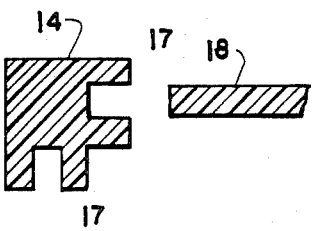
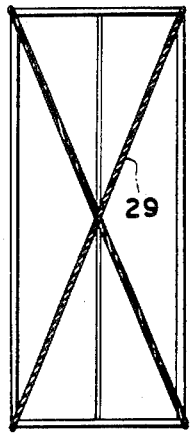
FIG. 11
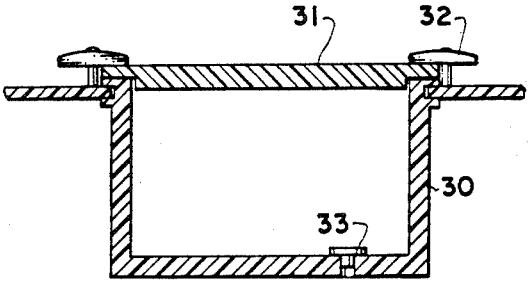
FIG. 12

FLOTATION ASSEMBLY

This invention relates to new and useful improvements in flotation assemblies, particularly flotation assemblies usable as boat docks, swimming platforms or the like.

BACKGROUND OF THE INVENTION

Conventionally, such docks are made with steel or wooden frames, either anchored to the bottom of the lake or river or, with flotation material incorporated therein.

The disadvantages of such constructions include firstly the relatively heavy weight and expense of the materials utilized and secondly the fact that they are not readily portable either for removal for storage purposes or for transportation purposes such as on a car top or the like.

PRIOR ART

Prior art known to applicant is as follows:

U.S. Pat. No. 3,605,148 P. L. Tailer. This deals with a float boat with a flat bottom sloping upwardly at its foreward end and having inflatable floats fixed below the flat bottom.

U.S. Pat. No. 3,595,192 Vega. This shows a floating cargo carrier having a rigid cargo support platform and an underlying gas inflatable float system.

U.S. Pat. No. 3,340,553 Jones. Discloses a marine float and method for making same and is basically in the form of a floatation buoy.

U.S. Pat. No. 3,446,172 Morton et al. Shows a pontoon floatation support consisting of a one piece tube filled with a cellular foamed material.

U.S. Pat. No. 3,844,236 Boyajain. This describes a dissemblable float having detachable side walls connected to form an enclosure in which are placed a plurality of float members.

U.S. Pat. No. 3,103,907 Scholley. Illustrates a floatable dock system comprising a modular assembly having a plurality of substantially identical float units attached to one another to form the dock system.

U.S. Pat. No. 1,496,110 Altree. Shows a log raft and method of forming same.

SUMMARY OF THE INVENTION

The present invention overcomes these disadvantages by providing a relatively light weight assembly having flotation means therein, which assembly can readily be removed if desired and, in one embodiment thereof, can be folded for easy transportation on a car top or the like. This means that they can be used for picnics or the like and can readily be assembled and launched whether utilized as a dock or swimming platform.

One aspect of the invention comprises a flotation module for use as a boat dock, swimming platform and the like, comprising in combination a substantially rectangular, vertically situated frame and an upper surface spanning the upper side edges of said frame, and flotation means in said frame and below said upper surface, said flotation means being situated one within each side of said frame and extending longitudinally thereof.

Another advantage of the invention is that the flotation components can either be foam, air bags, or other flotation material.

A further advantage of the invention is to provide a device of a character herewithin described in which it is easy to incorporate swimming ladders, anchoring devices, boat mooring devices, food storage wells and/or live bait wells.

Yet another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 8 is a schematic end view of an alternative embodiment to FIG. 6.

FIG. 9 is a fragmentary isometric view of the frame structure.

FIG. 10 is a fragmentary cross sectional view along the line 10—10 of FIG. 9.

FIG. 11 is a cross-sectional view showing one of the wells for live bait or food storage.

FIG. 12 is a top plan view of FIG. 3.

In the drawings like characters of reference indicate corresponding parts in the different figures.

DETAILED DESCRIPTION

Figure 1:
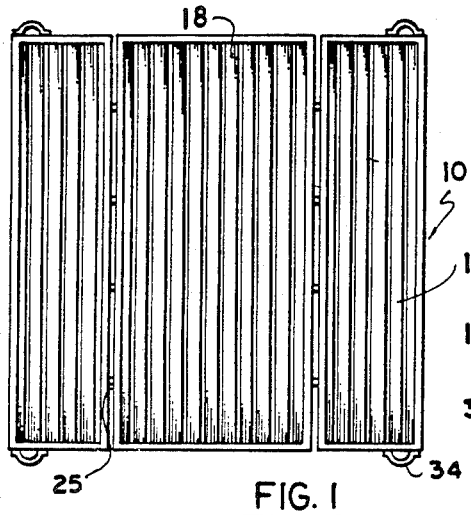
FIG. 1 is a top plan view of one embodiment of the invention.

Proceeding therefore to describe the invention in detail, reference character 10 shows, in plan view, one embodiment of the flotation assembly usable as a boat dock or swimming platform, it being understood that if used as a boat dock, it can be considerably longer than that illustrated.

It consists of a substantially rectangular frame collectively designated 11 preferably formed from synthetic plastic and including a pair of spaced and parallel sides 12 and a pair of spaced and parallel ends 13.

Each side member includes a longitudinally extending upper member 14 and a longitudinally extending lower member 15 situated in spaced and parallel relationship from the upper member 14 and maintained by means of vertical end members 16 and intermediate end members 17.

The end members are similarly constructed with upper members 14A and lower members 15A together with vertical members 16A.

FIG. 10 shows a cross-sectional view of the upper member 14A which includes a transversely extending groove 17 into which may be engaged longitudinally extending plastic planks 18 thus forming an upper surface 19 spanning the frame 11. These planks may be reinforced against deflection if required or, alternatively, transverse members (not illustrated) may extend between the upper members 14 in order to support the planks.

The entire structure being formed from a synthetic plastic is relatively lightweight yet strong enough for the purpose for which it is designed.

Flotation means are provided and may take the form of airbags, blocks of foam or other flotation material.

Figure 6:
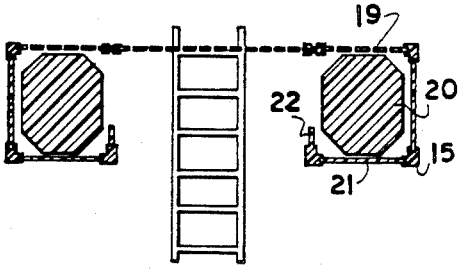
FIG. 6 is an end view of FIG. 5.
Figure 7:
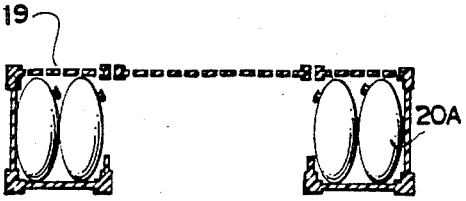
FIG. 7 is a schematic end view of an alternative embodiment of FIG. 6.

Reference character 19 shows airbags in FIG. 7 and reference character 20 shows elongated blocks of foam in FIG. 6.

FIG. 6 also shows means to retain these flotation components in position although with ends 13, these are not necessary. Also a ladder 33 as shown which may be detachably secured in a conventional manner to this and the other embodiments.

However, under normal circumstances, the end frames 13 are open so that retaining means are acquired. In FIG. 6 a base panel 21 extends inwardly from the lower member 15 of the side frames and a vertical retainer panel 22 extends upwardly from the inner edge of the panel 21 so that the flotation components are engaged between the sides 12 of the frame, the base panel 21 and the underside of the upper panel 19 are prevented from displacement by means of the vertical panels 22.

If the platform is relatively small it can be shipped or transported on top of a car merely by tying same down to a roof rack or the like. However if, as is usual, the platform is larger, then means are provided so that they can be folded to enable such transportation to take place.

Figure 2:
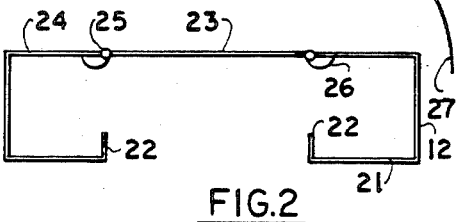
FIG. 2 is a schematic end view of the embodiment shown in FIG. 1, shown in the operative position.
Figure 3:
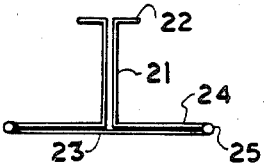
FIG. 3 is a view similar to FIG. 2 but showing the device in the inoperative or storage position.

FIGS. 2 and 3 show one method in which the top or upper surface is formed with a longitudinally extending center section 23 and a pair of side sections 24 hinged to the longitudinal edges of the center section 23 by means of hinges 25. These hinges are of the type which limits the hinging action to the horizontal position shown in FIG. 2 and reference character 26 shows such a method schematically. However such hinges are well known and it is not believed necessary to disclose details of construction thereof.

When in the position shown in FIG. 2, the flotation means may be engaged as described for FIG. 6 above and these may remain in position as the winged sections are hinged over in the direction of arrow 27, to the position shown in FIG. 3.

Figure 4:
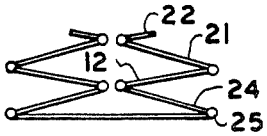
FIG. 4 is a schematic end view of an alternative embodiment of the device shown in the inoperative or stored position.

Even larger platforms may be hinged as shown schematically in FIG. 4 with a further hinge line 28 being provided between the sides 12 and the base panels 21 so that they may be folded to the position shown in FIG. 4. If desired, further hinges may be provided between the outer edges of the bases 21 and the retainers 22 so that the structure lies substantially planar when in the folded position shown in FIG. 4.

In both cases, the hinges 28 and, if provided, the hinges between base portions 21 and retainer panels 22 are of the type which limits the folding action to the position shown in FIG. 2.

FIG. 12 shows a folded configuration in plan under which circumstances ropes 29 may be utilized to hold the folded panels in the closed position during transportation and storage.

FIG. 8 shows a view similar to FIG. 6 in which airbags 20A may be utilized and FIG. 7 shows a larger structure in which double airbags 20A may be used on each side or, alternatively, double flotation means 20 depending upon design considerations.

If desired, wells 30 and 31 may be formed through the upper surface centrally thereof and depending below the upper surface between the flotation means 20 or 20A. These wells may be provided with detachable covers 31 held in position by means of turnbuckles 32 or the like and may be utilized for live bait storage or, for ice in order to keep food and beverages cool.

In both cases a drain plug 33 is provided at the base thereof.

Figure 13:
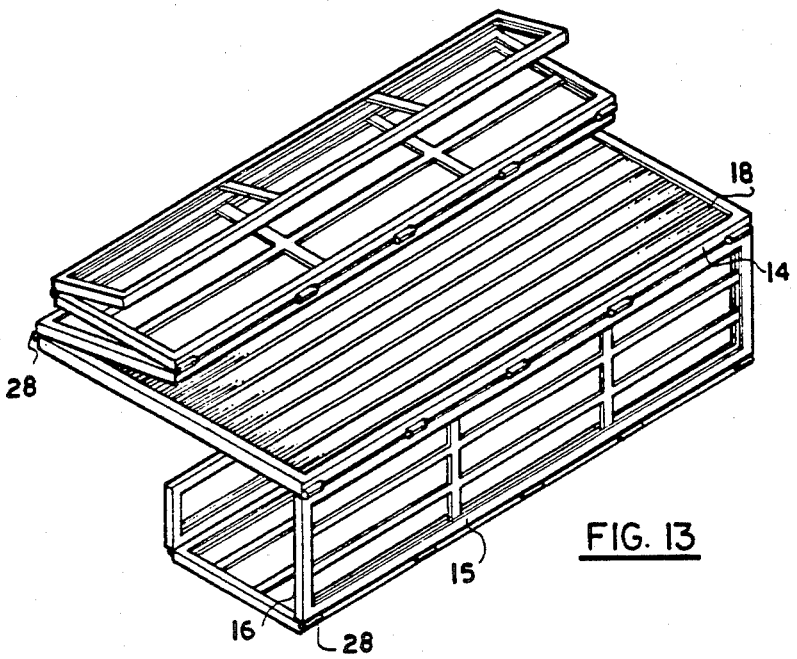
FIG. 13 is an isometric view similar to FIG. 4 showing one side in the operative position and the other side in the storage position.

FIG. 13 shows an isometric view of the embodiment illustrated in FIG. 4 with one side being in the operative position and the other side being in the folded or stored position.

Figure 14:
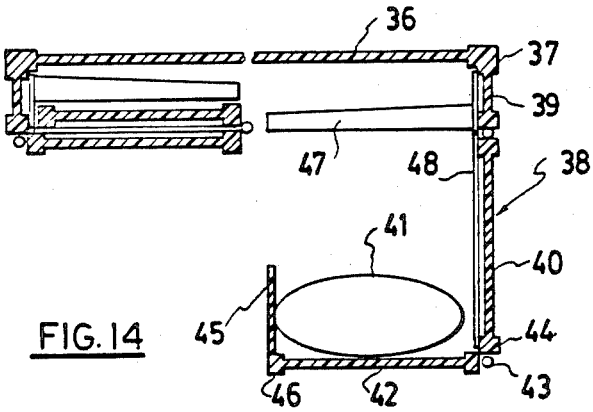
FIG. 14 is a cross sectional schematic view of a folding embodiment showing one of the side assemblies in the folded position and the extended position.
Figure 16:
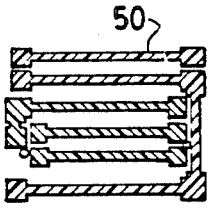
FIG. 16 is a schematic cross sectional view of the assembly of FIGS. 14 and 15 in the folded or stored position.
Figure 15:
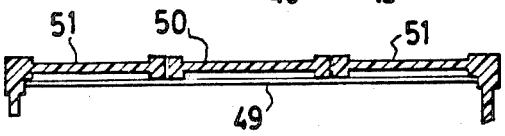
FIG. 15 is a fragmentary partially schematic cross sectional view of an embodiment which includes a central insert for the upper side thereof and is similar in construction to FIG. 14.

FIGS. 14, 15 and 16 show a further embodiment which includes the upper panel assembly 36 with a surrounding frame 37 also manufactured from synthetic plastic as hereinbefore described.

The sides collectively designated 38, in this embodiment, include the relatively short fixed sides 39 depending downwardly from the sides of the frame 37. A hinged side 40 extends from the lower edge of the fixed side 39 and means are provided to retain the flotation medium illustrated schematically by reference character 41, and take the form of base panels or members 42 hinged by the inner ends thereof as at 43, to the longitudinally extending lower edges 44 of the hinged side portions 40.

An upwardly extending flotation retainer member 45 is secured to the distal edge 46 of the base member 42 and assists in retaining the flotation unit shown schematically by reference character 41.

The size of this flotation member may of course vary and it may be an inflated air bag or formed from foam. Therefore a top retainer bar 47 is provided extending inwardly from the side 38 and being movable vertically along slide guides 48 which are conventional in construction.

The side and base assembly may be folded upwardly against this member 47 when in the storage position as shown in the left hand side of FIG. 14.

The top may be a solid panel or, alternatively, may be extendable on slide guides 49 in a manner similar to a table top assembly with a central substantially rectangular panel 50 being insertable when the two side panels 51 are in the fully extended position as shown in FIG. 15.

Under this circumstances, the entire assembly may be folded upwardly as shown in FIG. 16 with the top panel 50 being detachably held in place by ropes or the like on top of the folded assembly.

Figure 17:
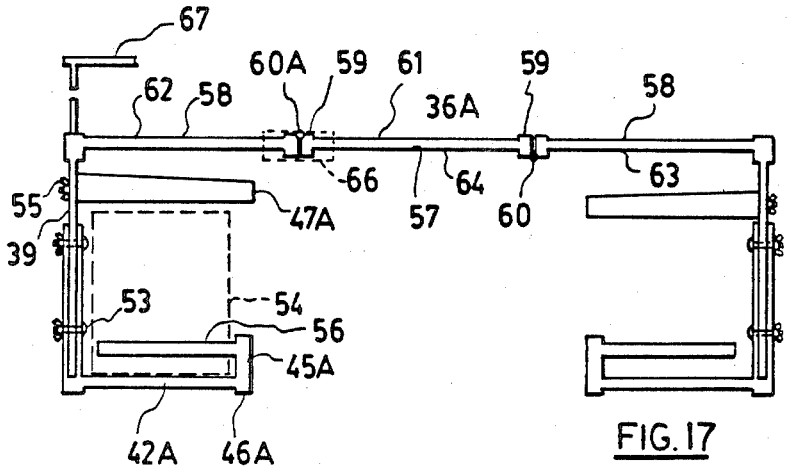
FIG. 17 is a schematic end elevation of an alternative construction to FIGS. 14 through 16.
Figure 18:
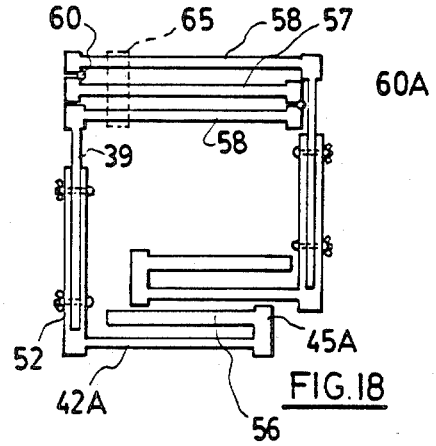
FIG. 18 is a schematic end view of FIG. 17 in the folded or stored position.

FIGS. 17 and 18 show a still further embodiment similar in construction to FIG. 14 with the exception that the base members 42A are solidly connected to the lower ends of the sides 52 and extend inwardly as clearly shown. This sides 52 are extendable and retractable vertically by means of the slotted construction (not illustrated) and wing nuts and bolts 53 extending therethrough as shown in FIG. 17. This allows the sides to be shortened in height for storage purposes and adjusted for the receipt of flotation modules 54. The top members 47A are similar to those shown in FIG. 14 with the exception that they are secured through a slot (not illustrated) in the fixed side portion 39, by means of wing nuts and bolts 55.

Also of note is the upwardly extending retainer portion 45A along the inner edge 46A of the base members 42A and the inwardly extending horizontally situated retainer portion 56 to prevent endwise movement of the flotation component 54.

Also of interest is the method of folding the upper panel 36A which consists of a central section 57 and a pair of side sections 58 one upon each side thereof and hinged to the longitudinal edges 59 of the centre section 57. It should be noted that one hinge 60 is on the underside of the side 57 and 58 and the other hinge 60A is on the upper side thereof thus enabling the centre section to be folded over onto the left hand panel 58 (with reference to FIG. 17) so that the upper surface 61 of the centre section is in interfacial relationship with the upper surface 62 of the left hand outer section.

Figure 19:
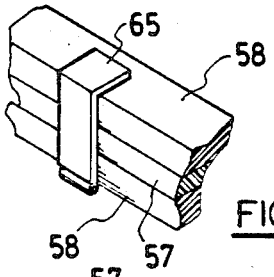
FIG. 19 is a fragmentary isometric view showing one method of clamping the assembly in the position shown in FIG. 18.
Figure 20:
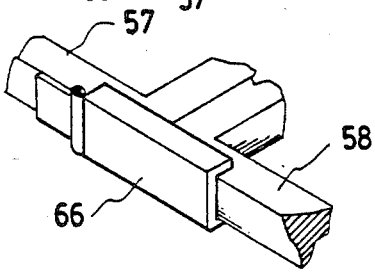
FIG. 20 is a fragmentary isometric view showing one method of maintaining the upper surface of FIG. 17 in the extended position.

The right hand outer section 58 is then folded in the opposite direction so that the under surface 63 is in interfacial relationship with the under surface 64 of the centre section in a position shown in FIG. 18. With the sides in the outer most position, a relatively small storage package is produced. FIG. 19 shows a hinged latch 65 which holds the 3 sections of the upper panel together when stored and FIG. 20 shows a horizontally hinged latch 66 which holds the hinged sections 57 and 58 when in the open position as shown in FIG. 17.

In all instances, detachable railings 67 may be socketed into apertures (not illustrated) formed around the perimeter of the upper surface, for safety purposes and the like.

Figure 21:
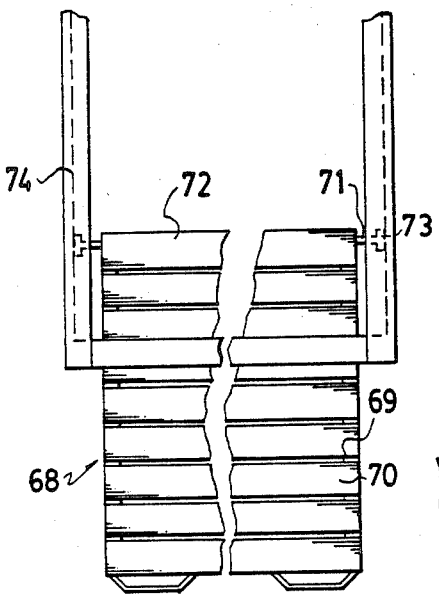
FIG. 21 is a fragmentary top plan view showing a boarding ramp partially extended.
Figure 22:
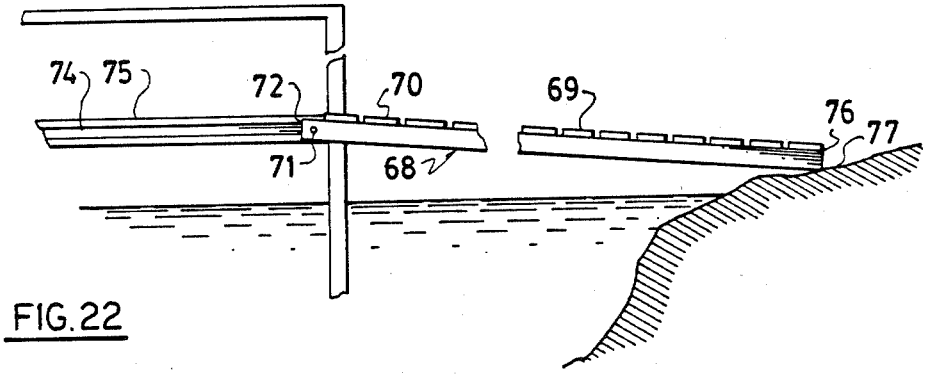
FIG. 22 is a fragmentary partially schematic side elevation of FIG. 21 but showing the boarding ramp fully extended.

FIG. 21 and 22 show an extending boarding ramp 68 normally stored under the upper surface of the flotation modules. This consists of a planar support surface 69 having transversely extending spaced and parallel cleats 70 formed or secured to the upper surface. Means are provided to slide the boarding ramp into the stored position below the upper surface or outwardly and the operating position as shown in FIG. 22, said means preferably taking the form of outwardly extending pins 71 adjacent the rear edge 72 of the ramp with enlarged ends or rollers 73 running within slots 74 formed on the inner sides 75 of the outer frame members. This form of mounting or the equivalent, permits the distal or free end 76 of the ramp to pivot upwardly or downwardly in a vertical arc so that it can rest upon a support 77 on shore and allow for limited upward and downward floating movement of the dock assembly.

Figure 23:
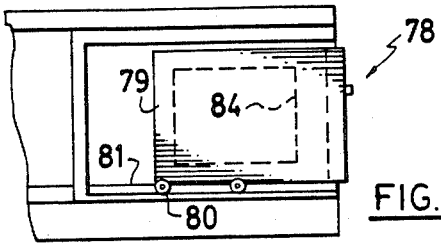
FIG. 23 is a fragmentary partially sectioned and schematic view of an outboard motor mount in the retracted position.
Figure 24:
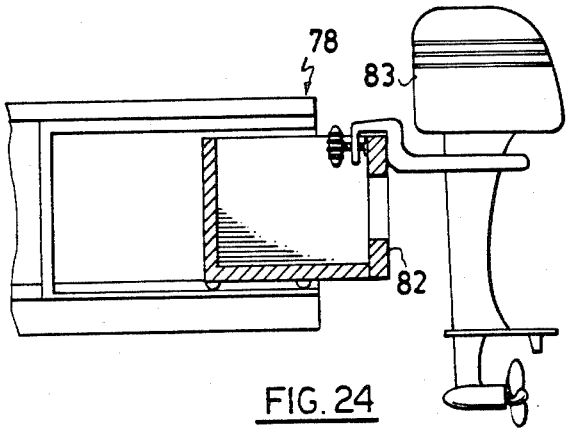
FIG. 24 is a view similar to FIG. 23 but showing the mount in the extended position.

FIGS. 23 and 24 show an outboard motor support assembly collectively designated 78 in the form of a drawer 79 slidable below the upper surface of the ramp or extendable outwardly as shown in FIG. 24. It may be mounted upon rollers 80 engaged within guides 81 and include means (not illustrated) to limit the outward movement to the position shown in FIG. 24.

The rear vertical panel 82 forms a transom plate to which a small outboard motor may be attached indicated in phantom and by reference character 83.

The transom plate may be adjustable vertically to allow for different lengths of the motor stem such as providing a plurality of such transverse plates 82 operating in vertical slides (not illustrated) within the drawer sides.

The drawer may hold a small gasoline tank or a battery, if the motor is electrically operated, indicated in phantom by reference character 84.

Figure 5:
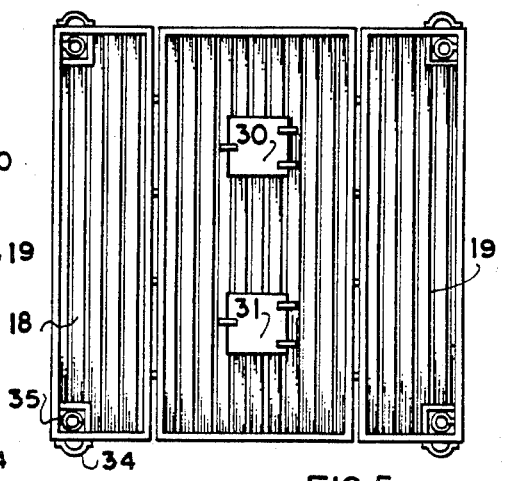
FIG. 5 is a top plan view of a further embodiment of the device.

Although two storage wells 30 are shown in FIG. 5, nevertheless others may of course be provided depending upon the design parameters and may be used for the storage of food and drink, bait, life jackets, first aid kit, tackle box, camp stove, fire extinguisher, tool box, to mention just a few items which may be stored therein.

Also, paddles, fishing rods or the like may be stored below the other support surface when the device is not in use.

All embodiments may include end rings 34 adjacent each side edge thereof which can be utilized for mooring purposes or can receive stakes (not illustrated) engaged therethrough and embedded within the lake or river bed to stabilize the structure. Furthermore boat anchor rings 35 may be recessed adjacent the corners or edges of the upper surface which can be raised when it is desire to moor the structure to a fixed location or to moor a boat thereto.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A flotation module for use in water comprising in combination a substantially rectangular, vertically situated frame including upper side edges and an upper surface spanning said upper side edges of said frame, and flotation means in said frame and below said upper surface, said flotation means being situated one within each side of said frame and extending longitudinally thereof, said frame being formed from synthetic plastic and including a pair of longitudinally extending sides and a pair of ends, each of said sides including an upper longitudinally extending member and a lower longitudinally extending member spaced and parallel to said member, at least one intermediate longitudinally extending member between said upper and lower members, and means to detachably retain said flotation means in said frame; said means to detachably retain said flotation means including a base panel extending inwardly from the lower edges of each of said longitudinally extending lower members, parallel to said upper surface, said flotation means engaging said side, said base member and the underside of said upper surface, said longitudinally extending side being hingedly secured along the longitudinal edges of said upper surface whereby said side and said base member can fold downwardly to an operating position and upwardly to rest on said upper surface in an inoperative and storage position, said base member also being hinged to the longitudinally extending lower member and being foldable upwardly to adjacent the inner surface of said longitudinally extending side.

2. The module according to claim 1 in which said upper surface includes a plurality of synthetic plastic boards extending between the ends of said frame and engaging transverse slots formed in said ends of said frame.

3. The module according to claim 1 in which said base panel includes a pair of longitudinally extending panels, longitudinally hinged together, an inner base panel and an outer base panel, said inner base panels being longitudinally hinged to the lower edge of said side, said inner panel hinging inwardly to lie substantially at right angles to said side, said outer panel hinging over said inner panel to lie substantially planar therewith and means to detachably secure said flotation means between said base and said upper surface when unfolded.

4. The module according to claim 3 in which said upper surface includes a pair of longitudinally extending panels slidably mounted for upward and inward planar movement and at least one insert central panel engaged between said upper panels when said pair of upper panels is in the outer most position.

5. The module according to claim 3 in which means to secure said flotation means includes an inwardly extending retainer bar adjustably mounted for vertical movement to said sides for selective engagement with the upper side of said flotation means thereby detachably clamping same against said outer base panel.

6. The module according to claim 1 in which said frame and said upper surface are integral and include three substantially rectangular panels, namely, a central panel and a side panel on each side of said central panel, said side panels being hingedly connected to said central panel by adjacent longitudinally extending side edges and foldable from an open planar position to a stored position whereby the upper surface of the central folds over in interfacial relationship with the upper surface of one side panel and the under surface of the other side panel folds over in interfacial relationship with the under surface of said central panel.

7. The module according to claim 1 which includes means to detachably retain said flotation means, said means to detachably retain said flotation means including a downwardly extending side on the outer edge of each of said side panels, an inwardly extending base member extending inwardly at right angles from the lower edge of said sides, a flotation retainer extending upwardly from the inner edges of said base members and an enclosure member extending inwardly from said sides and being adjustable vertically to engage the upper side of said flotation means.

8. The module according to claim 7 in which said base member is also adjustable vertically relative to said rectangular panels.

9. The module according to claim 8 which includes means to selectively clamp said hinged connections in the open planar position or in the storage position.

10. The module according to claim 1 which includes a docking ramp slidably stored beneath said upper surface for extension from and retraction under said upper surface, means under said upper surface to mount said ramp for said extension and retraction, the distal end of said ramp, when extended, pivoting in a vertical arc within limits.

11. The module according to claim 6 which includes a docking ramp slidably stored beneath said upper surface for extension from and retraction under said upper surface, means under said upper surface to mount said ramp for said extension and retraction, the distal end of said ramp, when extended, pivoting in a vertical arc within limits.

12. The module according to claim 7 which includes a docking ramp slidably stored beneath said upper surface for extension from and retraction under said upper surface, means under said upper surface to mount said ramp for said extension and retraction, the distal end of said ramp, when extended, pivoting in a vertical arc within limits.

13. The module according to claim 1 which includes extending and retracting means in said frame for detachably supporting an outboard motor, said last mentioned means including a support transom mounted for supported and horizontal sliding movement, said support transom being adjustable in height within limits, to receive said outboard motor when in the extended position.

14. The module according to claim 6 which includes extending and retracting means in said frame for detachably supporting an outboard motor, said last mentioned means including a support transom mounted for supported and horizontal sliding movement, said support transom being adjustable in height within limits, to receive said outboard motor when in the extended position.

15. The module according to claim 7 which includes extending and retracting means in said frame for detachably supporting an outboard motor, said last mentioned means including a support transom mounted for supported and horizontal sliding movement, said support transom being adjustable in height within limits, to receive said outboard motor when in the extended position.

16. The module according to claim 11 which includes extending and retracting means in said frame for detachably, supporting an outboard motor, said last mentioned means including a support transom mounted for supported and horizontal sliding movement, said support transom being adjustable in height within limits, to receive said outboard motor when in the extended position.

17. The module according to claim 1 in which said base panel includes a pair of longitudinally extending panels, longitudinally hinged together, an inner base panel and an outer base panel, said inner base panels being longitudinally hinged to the lower edge of said side, said inner panel hinging inwardly to lie substantially at right angles to said side, said outer panel hinging over said inner panel to lie substantially planar therewith and means to detachably secure said flotation means between said base and said upper surface when unfolded.

18. The module according to claim 1 in which said means to secure said flotation means includes an inwardly extending retainer bar adjustably mounted for vertical movement to said sides for selective engagement with the upper side of said flotation means thereby detachably clamping same against said base panel.

19. The module according to claim 17 in which said means to secure said flotation means includes an inwardly extending retainer bar adjustably mounted for vertical movement to said sides for selective engagement with the upper side of said flotation means thereby detachably clamping same against said outer base panel.

20. A flotation module for use in water comprising in combination a substantially rectangular, vertically situated frame including upper side edges and an upper surface spanning said upper side edges of said frame, and flotation means in said frame and below said upper surface, said flotation means being situated one within each side of said frame and extending longitudinally thereof, said frame being formed from synthetic plastic and including a pair of longitudinally extending sides and a pair of ends, each of said sides including an upper longitudinally extending member and a lower longitudinally extending member spaced and parallel to said upper member, and at least one intermediate longitudinally extending member between said upper and lower members, said upper surface including a plurality of synthetic plastic boards extending between the ends of said frame and engaging transverse slots formed in said ends of said frame.

21. A flotation module for use in water comprising in combination a substantially rectangular, vertically situated frame including upper side edges and an upper surface spanning said upper side edges of said frame, and flotation means in said frame and below said upper surface, said flotation means being situated one within each side of said frame and extending longitudinally thereof, said frame being formed from synthetic plastic and including a pair of longitudinally extending sides and a pair of ends, each of said sides including an upper longitudinally extending member and a lower longitudinally extending member spaced and parallel to said upper member, and at least one intermediate longitudinally extending member between said upper and lower members, said frame and said upper surface being integral and including three substantially rectangular panels, namely a central panel and a side panel on each side of said central panel, said side panels being hingedly connected to said central panel by adjacent longitudinally extending side edges and foldable from an open planar position to a stored position whereby the upper surface of the central folds over in interfacial relationship with the upper surface of one side panel and the under surface of the other side panels folds over in interfacial relationship with the under surface of said central panel.

22. A flotation module for use in water comprising in combination a substantially rectangular, vertically situated frame including upper side edges and an upper surface spanning said upper side edges of said frame, and flotation means in said frame and below said upper surface, said flotation means being situated one within each side of said frame and extending longitudinally thereof, said frame being formed from synthetic plastic and including a pair of longitudinally extending sides and a pair of ends, each of said sides including an upper longitudinally extending member and a lower longitudinally extending member spaced and parallel to said upper member, and at least one intermediate longitudinally extending member between said upper and lower members, including means to detachably retain said flotation means, said means to detachably retain said flotation means including a downwardly extending side on the outer edge of each of said side panels, an inwardly extending base member extending inwardly at right angles from the lower edge of said sides, a flotation retainer extending upwardly from the inner edges of said base members and an enclosure member extending inwardly from said sides and being adjustable vertically to engage the upper side of said flotation means.

23. The module according to claim 22 in which said base member is also adjustable vertically relative to said rectangular panels.

24. The module according to claim 23 which includes means to selectively clamp said hinged connections in the open planar position or in the storage position.

25. A flotation module for use in water comprising in combination a substantially rectangular, vertically situated frame including upper side edges and an upper surface spanning said upper side edges of said frame, and flotation means in said frame and below said upper surface, said flotation means being situated one within each side of said frame and extending longitudinally thereof, said frame being formed from synthetic plastic and including a pair of longitudinally extending sides and a pair of ends, each of said sides including an upper longitudinally extending member and a lower longitudinally extending member spaced and parallel to said upper member, and at least one intermediate longitudinally extending member between said upper and lower members, and a docking ramp slidably stored beneath said upper surface for extension from and retraction under said upper surface, means under said upper surface to mount said ramp for said extension and retraction, the distal end of said ramp, when extended, pivoting in a vertical arc within limits.

26. A flotation module for use in water comprising in combination a substantially rectangular, vertically situated frame including upper side edges and an upper surface spanning said upper side edges of said frame, and flotation means in said frame and below said upper surface, said flotation means being situated one within each side of said frame and extending longitudinally thereof, said frame being formed from synthetic plastic and including a pair of longitudinally extending sides and a pair of ends, each of said sides including an upper longitudinally extending member and a lower longitudinally extending member spaced and parallel to said upper member, and at least one intermediate longitudinally extending member between said upper and lower members, and extending and retracting means in said frame for detachably supporting an outboard motor, said last mentioned means including a support transom mounted for support and horizontal sliding movement, said support transom being adjustable in height within limits, to receive said outboard motor when in the extended position.

27. A flotation module for use in water comprising in combination a substantially rectangular, vertically situated frame including upper side edges and an upper surface spanning said upper side edges of said frame, and flotation means in said frame and below said upper surface, said flotation means being situated one within each side of said frame and extending longitudinally thereof, said frame being formed from synthetic plastic and including a pair of longitudinally extending sides and a pair of ends, each of said sides including an upper longitudinally extending member and a lower longitudinally extending member spaced and parallel to said upper member, and at least one intermediate longitudinally extending member between said upper and lower members, said means to secure said flotation means including an inwardly extending retainer bar adjustably mounted for vertical movement to said sides for selective engagement with the upper side of said flotation means thereby detachably clamping same against said base panel.

* * * * *